United States Patent [19]

Becker et al.

[11] 4,401,399

[45] Aug. 30, 1983

[54] TWO PART MINE ROOF SUPPORT UNIT

[75] Inventors: Kunibert Becker, Werl; Burckhard Elsner; Gerd Dunkel, both of Lunen, all of Fed. Rep. of Germany

[73] Assignee: Gewerkschaft Eisenhutte Westfalia, Lunen, Fed. Rep. of Germany

[21] Appl. No.: 278,034

[22] Filed: Jun. 29, 1981

[30] Foreign Application Priority Data

Jun. 28, 1980 [DE] Fed. Rep. of Germany ..... 3024465

[51] Int. Cl.[3] ..... E21D 23/00

[52] U.S. Cl. ..... 405/299; 299/33

[58] Field of Search ..... 405/299, 298, 297, 300; 299/33

[56] References Cited

U.S. PATENT DOCUMENTS

| | | | |
|---|---|---|---|
| 3,197,965 | 8/1965 | Lee | 405/300 |
| 3,434,292 | 3/1969 | Heyer | 405/300 |
| 3,438,209 | 4/1969 | Grebe | 405/297 |
| 3,482,878 | 12/1969 | Floter | 405/299 X |
| 3,524,321 | 8/1970 | Wilkenloh | 405/300 |
| 3,812,681 | 5/1974 | Allen | 405/299 |
| 3,991,580 | 11/1976 | Allen | 405/299 |
| 4,008,578 | 2/1977 | Blumenthal | 405/300 X |
| 4,027,489 | 6/1977 | Walker | 405/297 X |
| 4,325,659 | 4/1982 | Plevak | 405/299 |

*Primary Examiner*—Nile C. Byers, Jr.

*Attorney, Agent, or Firm*—Sughrue, Mion, Zinn, Macpeak and Seas

[57] ABSTRACT

A mine roof support unit is constituted by two detachably connected parts. Each of the parts has a floor girder which supports a roof bar by means of a hydraulic prop. The roof support unit is intended for use at the lower end of an inclined longwall working which meets its access gallery at an angle other than 90°. The detachability of the two parts enables one of these parts to be removed from the working as its face is advanced. The removed part can then be transported to the other end of the working. Each of the parts is provided with means for detachably connecting an advance mechanism.

17 Claims, 3 Drawing Figures

TWO PART MINE ROOF SUPPORT UNIT

BACKGROUND TO THE INVENTION

This invention relates to a mine roof support unit, and to a longwall mineral mining installation.

A longwall mineral mining installation usually has a conveyor (such as a scraper-chain conveyor) extending alongside the longwall face. The conveyor supports a guide, along which a winning machine (such as a plough) is reciprocably driven to win mineral material from the face. A plurality of roof support units are positioned side-by-side on the goaf side of the conveyor. The roof support units are provided with advance mechanisms, which are connected to the conveyor. The advance mechanisms are used to advance the conveyor, and then to advance the roof support units themselves in a follow-up movement.

In one known arrangement, each roof support unit has its own advance mechanism, which has a pair of guide rods and a hydraulic advance mechanism. The front (face-side) ends of the guide rods of each advance mechanism are connected to the conveyor by means of a common head-piece. The rear (goaf-side) ends of these guide rods are attached to a slide piece slidably guided on the floor sill of the associated roof support unit. The advance ram of each advance mechanism is pivotably attached to the associated floor sill and to the associated slide piece. (see DE-OS No. 2 540 091).

It is also known to position the advance mechanisms between the roof support units, each advance mechanism being connected to the floor sills of both adjacent roof support units. In this case, each advance mechanism has a pair of hydraulic advance rams and a pair of guide rods; one ram, and one guide rod being associated with each of the adjacent floor sills. This arrangement is particularly useful in inclined longwall workings. (see DE-OS No. 2 758 663).

Problems arise, however, in longwall workings which are inclined and which do not extend at right-angles to their access galleries. In such a working, as the face is advanced, the roof support units move towards the lower gallery. Thus, from time to time, it is necessary to dismantle the lowest roof support unit (before it moves into the lower gallery); and to move that unit to the other end of the face, where it must be reconstructed and positioned in the working at the top end thereof. Because of the size and weight of known roof support units, and the constricted space within mine workings, these dismantling, transport and reconstruction operations are extremely troublesome and time-consuming. Moreover, when the roof support units used have a large transverse dimension, a large roof area at the end of the working is left unsupported when a roof support unit is dismantled.

The aim of the invention is to reduce the problems associated with the known installations.

SUMMARY OF THE INVENTION

The present invention provides a mine roof support unit constituted by two detachably connected parts, each part having a floor girder, and a roof bar supported above the floor girder by hydraulic prop means.

Thus, by positioning roof support units of this type at the lower end of an inclined working that meets its access gallery at an angle other than 90°, it is possible to remove the lower part of the end roof support unit, whilst leaving the upper part of that unit in place. Not only does this facilitate the dismantling, transport and reconstruction operations, but it also ensures more reliable roof support in the critical end zones of the working (there being only half the usual unsupported roof area to worry about).

Advantageously, each roof support unit part is provided with an advance mechanism, the advance mechanisms being attachable to an abutment member and being detachably secured to their respective roof support unit parts. In practice, the abutment member will usually be a longwall conveyor.

Each side of each roof support unit part may be provided with attachment means for detachably connecting an advance mechanism. Thus, in installations having advance mechanisms positioned between adjacent pairs of roof support units, the remaining upper roof support unit part left after removal of its lower part can be attached to an advance mechanism, so that this upper part can be reliably advanced by a pair of advance mechanisms positioned on opposite sides thereof. Preferably, the floor girder of each roof support unit part is provided, at each side thereof, with a respective guide rail; and the floor girder of each roof support unit part is provided, at each side thereof, with a respective bracket, the guide rails and brackets constituting said attachment means.

Advantageously, the two roof support unit parts are supported against each other by means of support plates which are detachably secured to the mutually-facing sides of their floor girders. In this case, the support plates may be detachably secured to the brackets and to the guide rails at the mutually-facing sides of the floor girders. Alternatively, the support plates may be detachably secured to the brackets at the mutually-facing sides of the floor girders, and to connectors which attach the guide rails at said sides to the floor girders.

Preferably, each of the roof support unit parts is provided with side plates attached to its roof bar, the side plates being positioned at the mutually-facing sides of the roof bars and constituting means for supporting the two roof support unit parts against one another.

The invention also provides a mineral mining installation coprising a longwall structure extending along a longwall working, and first and second sets of roof support units positioned side-by-side along the goaf side of the longwall structure, wherein the roof support units of the first set are each as defined above, said roof support units of the first set being positioned at one end of the working. Preferably, there are between two and five roof support units in the first set.

Advantageously, the longwall structure constitutes the abutment member. Conveniently, each of the roof support units of the second set has a roof bar supported above a pair of spaced floor girders by means of hydraulic props. The roof support units of the second set may have the same overall width as the roof support units of the first set. In other words, the width of each part of the roof support units of the first set is half the width of the roof support units of the second set.

Preferably, a respective advance mechanism is provided between each pair of adjacent roof support units, and wherein each advance mechanism is constituted by a pair of hydraulic advance rams and a pair of guide rods, a respective hydraulic advance ram and a respective guide rod being associated with the adjacent floor girder of each of the adjacent roof support units, and the guide rods being connected, at one end, to the longwall structure via a common head-piece. Each of the advance mechanisms may be detachably connected to the associated floor girders. Advantageously, the piston rod of each hydraulic advance ram associated with a floor girder of a roof support unit of the first set is pivotably attached to the adjacent bracket of that floor girder, the cylinder of that hydraulic advance ram being pivotably attached to a slide piece slidably mounted on the adjacent guide rail of that floor girder. Conveniently, the guide rod associated with each hydraulic advance ram attached to a floor girder of a roof support unit of the first set is connected, at the other end, to the slide piece attached to the cylinder of the associated hydraulic advance ram. This arrangement allows an advance mechanism to be attached to the floor girder of the part of a roof support unit of the first set which is positioned at said end of the working; this being possible for either part of such a roof support unit. Thus, each roof support unit or part thereof can be provided with advance mechanisms at both sides thereof, so that reliable advance movements are assured even in steeply inclined workings. Moreover, this arrangement permits the two parts of a roof support unit of the first set to be advanced independently of one another.

Preferably, the guide rods of each advance mechanism are detachably connected to their common head-piece. This facilitates dismantling of the advance mechanism positioned at said end of the working, when a roof support unit part is to be removed.

Advantageously, the hydraulic prop means of each roof support unit part of each of the roof support units of the first set is constituted by a pair of hydraulic props, the hydraulic props of each said roof support unit part being spaced apart in the direction in advance.

BRIEF DESCRIPTION OF THE DRAWINGS

A longwall mineral mining installation, incorporating roof support units constructed in accordance with the invention, will now be described, by way of example, with reference to the accompanying drawings, in which.

DESCRIPTION OF THE PREFERRED EMBODIMENT

Figure 2:
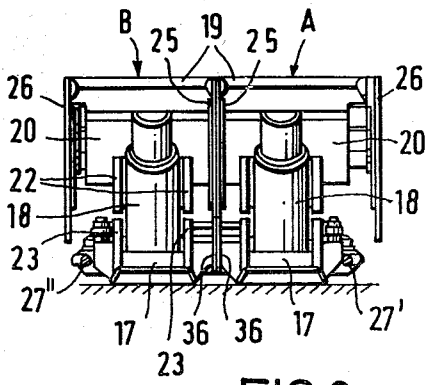
FIG. 2 is a front elevation of one of the roof support units constructed in accordance with the invention.
Figure 1:
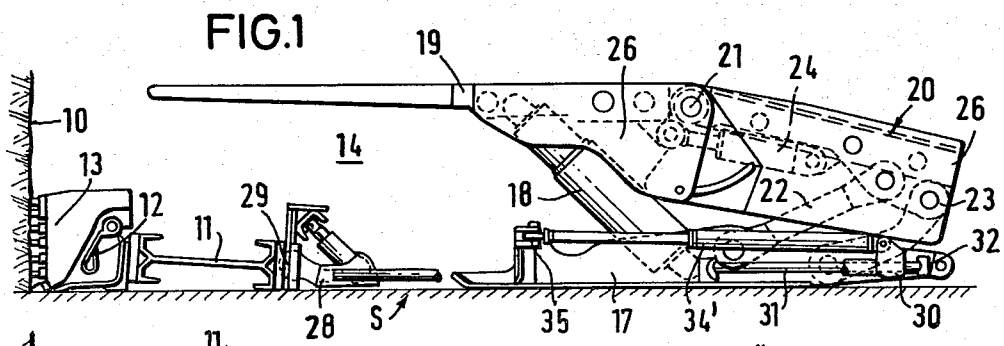
FIG. 1 is an end elevation of the installation.
Figure 3:
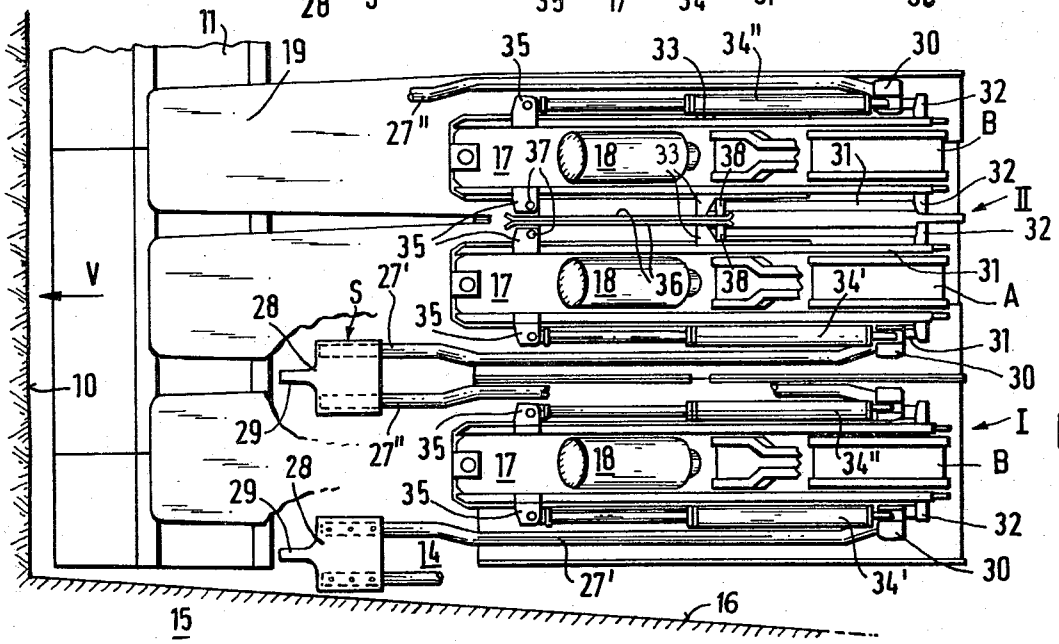
FIG. 3 is a plan view of one end portion of the installation.

Referring to the drawings, FIG. 1 shows a longwall working 14 having a mineral face 10 (for example, a coal face). A scraper-chain conveyor 11 extends alongside the face 10. As is usual, the conveyor 11 is made up of a plurality of sections joined together end-to-end. A guide is attached to the face side of the conveyor 11, and a plough 13 is reciprocable along the guide so as to win mineral material from the face 10. A roof support assembly is positioned at the goaf side of the conveyor 11, the roof support assembly being constituted by a plurality of roof support units positioned sie-by-side. As shown in FIG. 3, the working 14 extends at an obtuse angle to its access gallery 15. Moreover, the working 14 is inclined down towards the gallery 15.

Most of the roof support units are standard roof support units, each having a roof bar supported above a floor sill by means of hydraulic props. The floor sill of each of these standard roof support units is constituted by a pair of spaced floor girders. However, the lowest few (usually between two and five) roof support units are of a two-part construction. Each of these units I, II, etc. has two parts A and B. Thus, FIG. 3 shows both parts A and B of the roof support unit II, but only the part B of the roof support unit I (the part A of the roof support unit I having been removed from the bottom end of the working 14, and repositioned at the top end of the working—in a manner to be described below). The part B of the roof support unit I thus stands immediately adjacent to the edge 16 of the gallery 15. The entire width of each roof support unit I, II etc is 1500 millimeters, and this corresponds to the width of the standard roof support units. Thus, each of the parts A and B of the two-part units I, II etc has a width of 750 millimeters.

The roof support unit parts A and B are of identical construction, each having a floor girder 17, a hydraulic prop 18, a roof bar 19, and a goaf shield 20. The prop 18 is mounted in a universal joint (not shown) in the floor girder 17, and the roof bar 19 is similarly supported on the prop by means of a universal joint (not shown). The roof bar 19 is pivotally attached to the goaf shield 20 by means of a pivot joint 21. The goaf shield 20 is coupled to the floor girder 17 by means of a lemniscate linkage 22,23. A piston-and-cylinder unit 24 is positioned between the roof bar 19 and the goaf shield 20.

Each of the roof support unit parts A and B has side plates 25 and 26 attached to its roof bar 19 and goaf shield 20. The side plates 25 of the two parts A and B of each roof support I, II etc face one another and are rigidly secured to their roof bars 19 and goaf shields 20. The side plates 26, which are remote from one another, are, however, laterally movable relative to their roof bars 19 and goaf shields 20. The side plates 26 can be moved, either by springs or hydraulic bracing rams (not shown), so as to brace adjacent roof support units against one another for alignment purposes. The side plates 25 of each roof support unit I, II etc engage one another to provide mutual support for the two parts A and B The conveyor 11 is advanced, in the direction V of face advance, by means of a plurality of advance mechanisms S. The advance mechanisms S are positioned between adjacent roof support units along the entire length of the working. The advance mechanisms S are also used to advance the roof support units to follow up the advance of the conveyor 11. The advance mechanisms S are all the same, so one only (namely that positioned between the roof support units I and II) will be described in detail. This advance mechanism S has a pair of guide rods 27' and 27'', whose front (face-side) ends are connected to a common head-piece 28. The rods 27' and 27'' are cylindrical, and are made of resilient (springy) material. The head-piece 28 is connected to the conveyor 11 by means of a pivotal connector 29. The rear (goaf-side) end of each guide rod 27', 27'' is provided with a respective slide piece 30, which is slidably guided on a respective guide rail 31, each slide piece having a guide opening through which the corresponding guide rail extends. The guide rails 30 are cylindrical rods, whose opposite ends are secured, by means of connectors 32 and 33, to the two mutually-facing sides of the adjacent floor sills of the roof support units I and II. The advance mechanism S is provided with two double-acting hydraulic advance rams 34' and 34'', the cylinder of each of which is pivotally connected to a respective slide piece 30, and the piston rod of each of which is pivotally connected at 37 to a respective bracket 35 fixed to the side of the respective floor girder 17. The brackets 35 are fixed to the front (face-side) ends of the floor girders 17.

Thus, each complete roof support unit (such as the unit II) is connected to the conveyor 11 by means of two advance mechanisms S. Moreover, each advance mechanism S has one (its upper) guide rod 27' attached to the roof support unit uphill thereof, and its other (lower) guide rod 27" attached to the roof support unit downhill thereof. The arrangement is such that, retraction of the rams 34' and 34" associated with a given roof support unit which is braced in place by the extension of its props 18, is effective to advance the corresponding section of the conveyor 11 in the direction of the arrow V; and extension of these rams is effective to cause that roof support unit when released or embraced to make a follow-up advance movement.

As shown in FIG. 3, the roof support unit II is provided with upstanding support plates 36 secured to the mutually-facing sides of the floor girders 17 of the parts A and B. The support plates 36 engage one another to provide mutual lateral support for the parts A and B in the floor region. As mentioned above, the parts A and B are mutually laterally supported in the roof region by means of the side plates 25. Each of the support plates 36 is detachably secured, at its front (face-side) end, to the respective bracket 35. Similarly, the rear (goaf-side) end of each support plate 36 is detachably secured, by a respective bracket 38, to the corresponding guide rail 31 or the corresponding connector 32.

It will be apparent from FIG. 3, that, as the installation advances in the direction V, the roof support assembly gradually moves laterally towards the roadway 15 gallery edge 16. As soon as the first part A of the lowest roof support unit I enters the roadway, it is released from its advance mechanism S and its other part B, and removed from the roof support assembly. This position is shown in FIG. 3. The part A can then be moved to the other end of the working 14, where it is coupled to the adjacent roof support unit. The part A of the roof support unit I is disconnected by releasing the connection between its advance mechanism S and the conveyor 11. After removal of the part A, the support plate 36 of the part B of the roof support unit I is removed, by releasing the connections at the brackets 35 and 38. Then, the piston rod of the advance ram 34' of the just-dismantled advance mechanism S is attached to the bracket 35 of the part B. At the same time, a slide piece 30 is mounted on the guide rail 31 at the lower side of the part B of the roof support unit I. The cylinder of the ram 34' is then pivotally attached to this slide piece 30, and the slide piece is attached to the conveyor by means of a single guide rod 27' and a head-piece 28. This position is shown in FIG. 3. The part B of the roof support unit I can, therefore, be advanced by the rams 34' and 34", which are positioned on the opposite sides thereof.

The next roof support unit II can be advanced by the two advance mechanisms S positioned on the opposite sides thereof, the part B of the roof support unit I also being connected to the lower of these advance mechanisms, and the part A of the next higher roof support unit (not shown) also being connected to the higher of these advance mechanisms.

When, in the course of further face advance, the part B of the roof support unit I, moves into the gallery 15, this part is also dismantled. This is accomplished by releasing the head-piece 28 of the lowest advance mechanism S from the conveyor 11, and by releasing the guide rod 27" from the head-piece 28 on the opposite side of the part B of the roof support unit I. This part B can then be removed, and reconnected to its part A at the top end of the working 14. The roof support unit II then constitutes the lowest roof support unit in the working 14. At the gallery side, this unit is connected to the conveyor 11 by means of the guide rod 27' of the lower of its advance mechanisms S (the guide rod 27" of this advance mechanism having been removed with part B of the roof support unit I). The opposite side of the roof support unit II is connected to the conveyor 11 by means of the guide rod 27" of the upper advance mechanism S of that roof support unit.

It will be understood that all the detachable connections are designed for easy and rapid release and reattachment. For example, bolt couplings, or other quick-action couplings, are preferably used.

It will be appreciated that the roof support units described above could modified in a number of ways. For example, each roof support unit part A and B could have a plurality of hydraulic props 18, disposed one behind another in the direction of the arrow V. It is also possible to connect the side plates 25 and the support plates 36 to the parts A and B in a detachable manner.

We claim:

1. A mine roof support unit, comprising: two detachably connected parts (A, B), each part having a floor girder (17), and a roof bar (19) supported above the floor girder by hydraulic prop means (18), wherein each roof support unit part includes an advance mechanism (S), the advance mechanisms being attachable to an abutment member and being detachably secured to their respective roof support unit parts.

2. A roof support unit according to claim 1, wherein each side of each roof support unit part includes attachment means for detachably connecting an advance mechanism.

3. A roof support unit according to claim 2, wherein the floor girder of each roof support unit part includes, at each side thereof, a respective guide rail, and the floor girder of each roof support unit part includes, at each side thereof, a respective bracket, the guide rails and brackets constituting said attachment means.

4. A roof support unit according to claim 3, wherein the two roof support unit parts are supported against each other by means of support plates which are detachably secured to the mutually-facing sides of their floor girders.

5. A roof support unit according to claim 4, wherein the support plates are detachably secured to the brackets at the mutually-facing sides of the floor girders, and to connectors which attach the guide rails at said sides to the floor girders.

6. A roof support unit according to claim 1, wherein each of the roof support unit parts includes side plates attached to its roof bar, the side plates being positioned at the mutually-facing sides of the roof bars and constituting means for supporting the two roof support unit parts against one another.

7. A longwall mineral mining installation, comprising: a longwall structure extending along a longwall working, and first and second sets of roof support units positioned side-by-side along the goaf side of the longwall structure, wherein the roof support units of the first set each comprise two detachably connected parts (A, B), each part having a floor girder (17), and a roof bar (19) supported above the floor girder by hydraulic prop means (18), said first set of roof support units being positioned at one end of the working, wherein each roof support unit part includes an advance mechanism (S), the advance mechanisms being detachably secured to the longwall structure and being detachably secured to their respective roof support unit parts.

8. A mineral mining installation according to claim 7, wherein each of the roof support units of the second set has a roof bar supported above a pair of spaced floor girders by means of hydraulic props.

9. A mineral mining installation according to claim 8, wherein a respective advance mechanism is disposed between each pair of adjacent roof support units, and wherein each advance mechanism includes a pair of hydraulic advance rams and a pair of guide rods, a respective hydraulic advance ram and a respective guide rod being associated with the adjacent floor girder of each of the adjacent roof support units, and the guide rods being connected at one end, to the longwall structure via a common head-piece.

10. A mineral mining installation according to claim 9, wherein each of the advance mechanisms is detachably connected to the associated floor girders.

11. A mineral mining installation according to claim 10, wherein the floor girder of each roof support unit part includes, at each side thereof, a respective guide rail, and the floor girder of each roof support unit part includes, at each side thereof, a respective bracket, the guide rails and brackets constituting said attachment means.

12. A mineral mining installation according to claim 11, wherein the piston rod of each hydraulic advance ram associated with a floor girder of a roof support unit of the first set is pivotably attached to the adjacent bracket of that floor girder the cylinder of that hydraulic advance ram being pivotally attached to a slide piece slidably mounted on the adjacent guide rail to that floor girder.

13. A mineral mining installation according to claim 12, wherein the guide rod associated with each hydraulic advance ram attached to a floor girder of a roof support unit of the first set is connected, at the other end, to the slide piece attached to the cylinder of the associated hydraulic advance ram.

14. A mineral mining installation acccording to claim 9, wherein the guide rods of each advance mechanism are detachably to their common head-piece.

15. A mineral mining installation according to claim 7, wherein there are between two and five roof support units in the first set.

16. A mineral mining installation according to claim 7, wherein the longwall structure is a longwall scraper-chain conveyor.

17. A mineral mining installation according to claim 7, wherein the hydraulic prop means of each roof support unit part of each of the roof support units of the first set comprises a pair of hydraulic props, the hydraulic props of each said roof support unit part being spaced apart in the direction of advance.

* * * * *